United States Patent [19]

Ishii et al.

[11] Patent Number: 4,676,158

[45] Date of Patent: Jun. 30, 1987

[54] PLATE PRESSURE AND PRINTING PRESSURE ADJUSTING MECHANISM FOR OFFSET PRINTING MACHINE

[75] Inventors: Koji Ishii; Yukito Okuda, both of Hiroshima, Japan

[73] Assignee: Ryobi Ltd., Kalam, Japan

[21] Appl. No.: 843,415

[22] Filed: Mar. 24, 1986

[30] Foreign Application Priority Data

Mar. 26, 1985 [JP] Japan ..... 60-63131

[51] Int. Cl.[4] ..... B30B 15/32

[52] U.S. Cl. ..... 101/218; 101/142

[58] Field of Search ..... 101/141, 140, 143, 144, 101/145, 137, 177, 217, 218, 184–185

[56] References Cited

U.S. PATENT DOCUMENTS 2,578,700 12/1951 Harrolu et al. ..... 101/218
2,909,117 10/1959 Crissy ..... 101/217 X
4,458,591 7/1984 Guaraldi ..... 101/218

*Primary Examiner*—E. H. Eickholt
*Attorney, Agent, or Firm*—Sughrue, Mion, Zinn, Macpeak, and Seas

[57] ABSTRACT

A plate pressure and printing pressure adjusting mechanism for permitting separate adjustment of the pressure exerted by a rubber blanket cylinder against a plate cylinder and the same rubber blanket cylinder against an impression cylinder. First and second toggle mechanisms are mounted for reciprocation to opposite sides of the axis of rotation of the rubber blanket cylinder and in similar directions to bring the rubber blanket cylinder into and out of engagement with the plate cylinder and impression cylinder, respectively. A first arm fixedly mounted on the eccentric shaft supporting the rubber blanket cylinder is connected through the first toggle mechanism to a first adjusting arm pivotably supported on the frame, and supports an axial adjusting screw and being spring biased so as to cause the end of the adjusting screw to bear on a first radial cam whose periphery may be shifted. A second arm is pivotably supported on the frame with one portion coupled through a link to the eccentric metal part supporting the rubber blanket cylinder. The second toggle mechanism links the other portion of the second arm to a second adjusting arm pivotably supported on the frame and carrying a threaded adjustment screw whose threaded end bears on a second rotatably adjustable radial cam and maintained thereagainst by biasing means acting on the second adjusting arm. By rotating the adjusting cams, the first and second toggle mechanisms are individually adjusted to separately vary the plate pressure and printing pressure.

5 Claims, 1 Drawing Figure

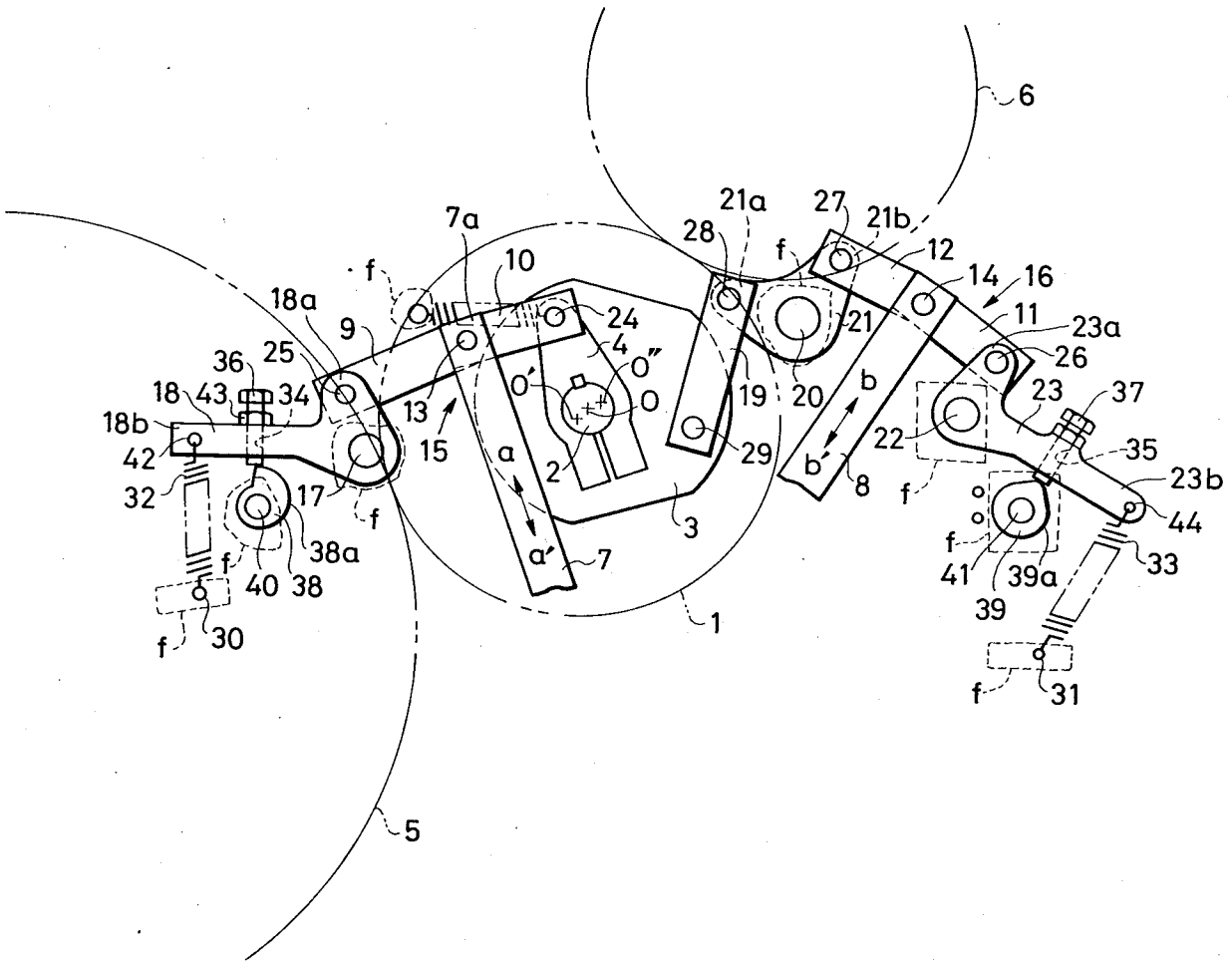
1
2
3
4
5
6
7
7a
8
9
10
11
12
13
14
15
16
17
18
18a
18b
19
20
21
21a
21b
22
23
23a
23b
24
25
26
27
28
29
30
31
32
33
34
35
36
37
38
38a
39
39a
40
41
42
43
44
a
a'
b
b'
o
o'
o''
f

PLATE PRESSURE AND PRINTING PRESSURE ADJUSTING MECHANISM FOR OFFSET PRINTING MACHINE

This application relates to U.S. application Ser. No. 844,031 filed Mar. 25, 1986, entitled "CYLINDER SETTING MECHANISM FOR PRINTING MACHINE" and assigned to the common assignee.

FIELD OF THE INVENTION

This invention relates to a plate pressure and printing pressure adjusting mechanism for an offset printing machine, and more particularly to a simplified adjusting mechanism facilitating separate adjustment of place pressure and printing pressure.

BACKGROUND OF THE INVENTION

In offset printing machines, typically an impression cylinder is mounted on a frame for rotation about a fixed axis and a plate cylinder is mounted for rotation about a fixed axis on said frame with its axis of rotation parallel to the axis of rotation of the impression cylinder and with the periphery of the plate cylinder spaced from that of the impression cylinder. Further, a rubber blanket cylinder is interposed between the impression cylinder and the plate cylinder with its axis of rotation parallel to the axes of rotation of the impression cylinder and the plate cylinder. Further, a mechanism is provided to cause the contact pressure of the rubber blanket cylinder against the plate cylinder and the impression cylinder to be adjusted to suitable values such that the image is uniformly transferred from the plate cylinder onto the rubber blanket cylinder and thence to the impression cylinder, and the printing pressure of the rubber blanket cylinder against the impression cylinder is in conformance to the printing sheet thickness interposed therebetween to provide prints of high resolution. Thus, the adjustment of the plate pressure as well as the printing pressure is a very important factor in the printing technique employed in offset printing.

A variety of plate pressure and printing pressure adjusting mechanisms have been employed in the past. However, the conventional mechanisms which are in use adjust the plate pressure and the printing pressure simultaneously, and therefore, the adjustment of these pressures is intricate, requires considerable time and labor, and it is difficult to set the plate pressure and the print pressure to suitable values.

It is, therefore, a primary object of the present invention to solve the difficulties of conventional plate pressure and printing pressure adjusting mechanisms for an offset printing machine and to provide a plate pressure and printing pressure adjusting mechanism in which the plate pressure and printing pressure may be adjusted separately and in which the operator can readily and quickly adjust the pressures accurately while observing the impression cylinder, the blanket cylinder and the plate cylinder during printing operation.

SUMMARY OF THE INVENTION

The invention is directed to a plate pressure and printing pressure adjusting mechanism for an offset printing machine, which printing machine comprises a frame, an impression cylinder mounted for rotation about a fixed axis on the frame, a plate cylinder mounted for rotation about a fixed axis on the frame parallel to the axis of rotation of the impression cylinder with the peripheries of the plate cylinder and impression cylinder spaced from each other, and wherein a rubber blanket cylinder is interposed between the pressure cylinder and plate cylinder and parallel thereto for peripheral contact with the plate cylinder and the impression cylinder. An eccentric metal part is mounted on the frame for rotation about an axis O''. Means are provided for mounting an eccentric shaft on the eccentric metal part for rotation about its shaft axis O, eccentric to the axis O'' of the eccentric metal part. Further, the eccentric shaft mounts the rubber blanket cylinder with the axis O' of the rubber blanket cylinder eccentric to the axis O of the eccentric shaft. The plate pressure and printing pressure adjusting mechanism comprises first and second toggle mechanisms positioned on the machine for reciprocation in predetermined directions to effect shifting of the rubber blanket cylinder into and out of peripheral engagement with the plate cylinder and the impression cylinder. A first arm is fixedly mounted on the eccentric shaft of the rubber blanket cylinder. A first adjusting arm is pivotably supported on the frame, and the first adjusting arm is coupled through the first toggle mechanism to said first arm. A second arm is coupled through a link to the eccentric metal part and is pivotably supported on the frame. A second adjusting arm is pivotably supported on said frame and is coupled through the second toggle mechanism to the second arm. Tension springs are connected to the first and second adjusting arms, respectively, and to the frame, and adjusting screws are threadably engaged with the first and second adjusting arms. The frame carries adjusting cams which abut the threaded ends of the adjusting screws, which are maintained in contact with the end of the screws by the adjusting springs and the adjusting cams are pivotably mounted on the frame such that by adjusting the positions of the cams, the first and second adjusting arms may be shifted independently, whereby the rubber blanket cylinder may be separately shifted through the first and second toggle mechanisms to separately adjust the plate pressure and printing pressure of the rubber blanket cylinder on the plate cylinder and the impression cylinder, respectively, readily and with accurate fine adjustment.

The means for engaging the rubber blanket cylinder with the impression cylinder and the plate cylinder and for disengaging the same comprises a cylinder setting device having two actuator links mounted for reciprocation on opposite sides of the rubber blanket cylinder eccentric shaft and in similar directions to effect engagement and disengagement of the rubber blanket cylinder, and form elements of the first and second toggle mechanisms, and wherein the first toggle mechanism comprises a first toggle link pivotably mounted to the end of the reciprocating first actuator link and pivotably connected to the first arm remote from the first arm connection to the eccentric shaft of the rubber blanket cylinder. The first adjusting arm comprises an L-shaped arm having intersecting portions at the pivot support of the first adjusting arm on the frame. One of these portions is proximate to the rubber blanket cylinder and is pivitably connected, at its end to the second toggle link of the first toggle mechanism. The end of the second portion of the first adjusting arm, remote from the pivot connection of the first adjusting arm to the frame, is connected to the first adjusting spring. The second portion of the first adjusting arm, intermediate of the spring connection and the pivot connection of the first adjusting arm on the frame, carries the adjusting screw, whose threaded end abuts one of the adjusting cams.

The cylinder setting device second actuator link, forming part of the second toggle mechanism, is pin connected at one end to paired toggle links of the second toggle mechanism, one toggle link of which is pivotably connected at the end remote from the cylinder setting device second actuator link to one end of said second arm, said second arm being L-shaped and having right angle portions pivotably connected at the intersection of the two L-shaped portions of the arm to the frame. The end of the other portion is pin connected to a link, which link, in turn, is pin connected to the eccentric metal part at a point outwardly of the axis of rotation of the eccentric metal part. The second toggle mechanism includes a second toggle link, pin connected at one end to the end of the cylinder setting device second actuator link. The second adjusting arm comprises an L-shaped arm having two generally right angle portions and being pivotably supported on the frame at the intersection of the two right angle portions. One of the portions, proximate to the rubber blanket cylinder, is connected to the end of the second toggle mechanism second toggle link. The other portion of the second adjusting arm has an end remote from the second adjustment arm pivot connection to the frame, being connected to the second adjusting spring, and an adjusting screw carried by the second adjusting arm is threaded on the second arm portion, intermediate of the pivot connection to the frame and the connection of the second adjustment spring to that arm portion, whose threaded end projects from the second arm portion and bears on the other adjusting cam.

The adjusting cams may comprise radial cams fixedly mounted to respective operating shafts, which shafts are rotatably mounted on the frame such that rotation of the cams permits the ends of the adjusting screws to follow radially varying peripheral surfaces of the radial cams fixed to the operating shafts.

BRIEF DESCRIPTION OF THE DRAWINGS

The single FIGURE is a schematic side elevational view of a plate pressure and printing pressure adjusting mechanism forming a preferred embodiment of the present invention.

DESCRIPTION OF THE PREFERRED EMBODIMENT

The embodiment of the present invention illustrated schematically in the single FIGURE in the accompanying drawing is applied to an offset printing machine composed principally of a rubber blanket cylinder 1 interposed between and movable into peripheral engagement with an impression cylinder 5 to the left, and a plate cylinder 6 to the right and above rubber blanket cylinder 1. The rubber blanket cylinder 1 is rotatably supported on a frame, portions of which are shown at several areas in the drawings and indicated at f. The mechanism shown may be duplicated at both ends of the printing machine cylinders supported by laterally spaced vertical frame walls or members (not shown). The frame f, thus, includes operating and nonoperating sides to the front and rear of cylinders 1, 5 and 6. Rotatable support is achieved by means of a rubber blanket cylinder eccentric shaft 2 and an eccentric metal part 3. An arm 4 is fixedly coupled to the rubber blanket cylinder eccentric shaft 2 and rotates therewith so that, as the rubber blanket cylinder eccentric shaft 2 is turned counterclockwise in the FIGURE, around its central axis O, the rubber blanket cylinder 1 moves away from the impression cylinder 5 because the central axis O′ of the rubber blanket cylinder is eccentric relative to the rubber blanket cylinder eccentric shaft axis O. As a result of this movement, the printing pressure exerted by the rubber blanket cylinder 1 on the impression cylinder 5 is decreased. Further, as the rubber blanket cylinder eccentric shaft 2 is rotated clockwise in the FIGURE, the printing pressure of the rubber blanket cylinder 1 against the impression cylinder 5 is increased for the same reason. Further, the arrangement of the eccentric metal part 3, the eccentric shaft 2, and the rubber blanket cylinder 1 is such that, if the eccentric metal part 3 is turned counterclockwise, in the FIGURE, about its axis O″, the axis O of the rubber blanket cylinder moves downwardly relative to the axis O″ of the eccentric metal part 3. This causes the rubber blanket cylinder 1 to move away from the plate cylinder 6 as a result of which the plate pressure applied by the rubber blanket cylinder against the plate cylinder 6 decreases. Alternatively, as the eccentric metal part 3 is turned clockwise about its axis O″, the plate pressure of the rubber blanket cylinder 1 against the plate cylinder 6 is increased.

Further reference may be had to U.S. application Ser. No. 844,031 cited above with respect to the mounting of the eccentric metal part 3, the shaft 2 and rubber blanket cylinder 1, and the content thereof is incorporated herein by reference.

The rubber blanket cylinder 1 is engaged with and disengaged from the impression cylinder 5 and the plate cylinder 6 by means of a cylinder setting device which is otherwise not shown except for cylinder setting device actuator links 7 and 8. The actuator links 7 and 8 extend in oblique or diverging directions relative to each other and the cylinder setting device causes the links 7 and 8 to reciprocate in the directions of arrows a–a′ and b–b′ to effect engagement and disengagement of the rubber blanket cylinder, respectively, with the impression cylinder 5 and the plate cylinder 6. These actuator links 7 and 8 form components of toggle mechanism 15 and 16, respectively.

The toggle mechanism 15 further comprises two toggle links 9 and 10 which are commonly rotatably coupled by pin 13 to end 7*a* of actuator link 7 to thus form therebetween, toggle mechanism 15. Similarly two toggle links 11 and 12 are each rotatably coupled at one end thereof to end 8*a* of actuator link 8 of toggle mechanism 16 by pin 14, and thus, between them, form that toggle mechanism. With respect to toggle mechanism 15, the toggle link 10 is pivotably connected via pin 24 to the end of the arm 4 remote from shaft 2 to which it is coupled.

Further, the plate pressure and printing pressure adjustment mechanism includes a first adjusting arm 18 which is of modified L-shaped configuration including generally right angle arm ends or portions 18*a*, 18*b*. In the area of intersection of the arm portions 18*a*, 18*b*, the adjusting arm 18 is rotatably mounted on a stud shaft 17, which stud shaft 17 is embedded in frame f or an arm thereof. Further, with respect to toggle mechanism 15, the toggle link 9 is pivotably coupled through pin 25 at the end of the toggle link 9, remote from its coupling to actuator link 7, to arm portion 18*b* of the adjusting arm 18, remote from its connection to frame f by stud shaft 17.

While the first end or portion 18*a* of adjusting arm 18 is pivotably coupled to link 9, the second portion or second end 18*b* of arm 18, remote from the pivot axis defined by stud shaft 17 supported by frame f or by an arm thereof, is connected by via hole or pin 42 to one end of a tension coil spring 32, the opposite end being connected via pin 30 or a spring hook to the frame f, or an arm thereof. Thus, the adjusting arm 18 is biased so as to rotate counterclockwise in the drawing about the pivot axis defined by stud shaft 17. The adjusting arm portion 18*b* is provided with a tapped or threaded hole 34 which receives the threaded end of an adjusting screw 36. The adjusting screw 36 also threadably supports a lock nut 43. Beneath the adjusting arm 18*b*, there is provided a radial type adjusting cam 38 which is fixed to a shaft 40 rotatably mounted on the frame f. The radial cam 38 has an arcuate cam surface 38*a* of varying radius. The cam surface 38*a* faces and is in abutment with the end of the adjusting screw 36 projecting through adjusting arm portion 18*b* intermediate of the pivot axis as defined by stud shaft 17 and pin 42 to which one end of the tension spring 32 is coupled. The arcuate cam surface 38*a* may be smooth or it may include a circumferential groove (not shown) in which the end of screw 36 may slidably fit.

Turning to the opposite side of the rubber blanket cylinder 1, toggle mechanism 16 is linked to a second adjusting arm 23 and also to eccentric metal part 3. Toggle mechanism toggle links 11 and 12 are commonly pin connected at one end to end 8*a* of actuator link 8. The eccentric metal part 3 is coupled through a link 19 and a rocking lever or rocking arm 21 to toggle link 12 to toggle mechanism 16. In that respect, link 19 is pin connected, at one end, by pin 29 fixed to the eccentric metal part 3 and projecting outwardly thereof, while the opposite end of the link 19 is connected, via a pin 28, to one right angle portion 21*a* of L-shaped arm or lever 21. The lever or arm 21 is pin connected at the intersection of its two right angle portions 21*a*, 21*a* to frame f. The other portion 21*b* of the lever or arm 21 is pin connected, at its end remote from the support shaft 20 which is embedded in the frame f, to the toggle lever 12 at its end remote from the end connected to actuator link 8.

The plate pressure and printing pressure adjusting mechanism further includes a second adjusting arm 23 which is essentially a mirror image of the first adjusting arm 18 and includes generally right angle portions 23*a* and 23*b*. At the intersection of the two portions 23*a*, 23*b*, adjusting arm 23 is rotatably supported on the frame f through a stud shaft 22. The end of the adjusting arm portion 23*b*, remote from stud shaft 22, includes a hole or pin 44 which mounting one end of the tension spring 33. The opposite end of the spring is fixedly connected to the frame f or its equivalent via a hook or pin 31. Intermediate of the stud shaft 22 and the end of adjusting arm portion 23*b*, the adjusting arm portion 23*b* carries a tapped or threaded hole 35 extending through the same within which is threadably positioned, an adjusting screw 37. The adjusting screw 37 carries a locking nut 45 for locking the adjusting screw 37 at a desired axially adjusted position. The end of the adjusting screw 37 bears on the periphery of a radial cam 39 and is in contact with the peripheral cam surface 39*a* of that member. Cam 39 is fixed to or integral with a rotatable operating shaft 41, carried by frame f such that by rotating the shaft 41, a radially varying peripheral portion of cam surface 39*a* is presented to the projecting end of the adjusting screw 37. The coil spring 33 maintains the end of the adjusting screw in contact with the cam surface 39*a* of radial cam 39. The cam surface 39*a* of the radial cam 39 may be smooth or may have a circumferential groove similar to that discussed with respect to cam 38, receiving the end of screw 37.

Thus adjusting arm 38 is urged by spring 32 to rotate counterclockwise, as shown in the drawing, while the adjusting arm 23 is urged by spring 33 to rotate clockwise.

In the structural assembly shown, the axis of the rubber blanket cylinder eccentric shaft 2 and that of the eccentric metal part 3 are positioned after taking the structural arrangement of the cylinders 1, 5 and 6 into consideration. That is, the axes of shaft 2 and eccentric metal part 3 are so positioned that the plate pressure exerted by the rubber blanket cylinder 1 and the printing pressure exerted by that same cylinder can be suitably adjusted, and wherein the adjustment of these pressures are other than one-sided.

As may be further appreciated, the plate pressure and printing pressure adjusting mechanism as thus constructed is controlled by means of actuator links 7 and 8. The cylinder setting device of which actuator links 7 and 8 are components thereof, functions to move the actuator links 7 and 8 in the direction of their longitudinal axes. For example, as the actuator link 7 is moved in the direction of arrow a to the position shown in the FIGURE, the rubber blanket cylinder eccentric shaft 2 is caused to rotate clockwise through arm 4 due to the action of the toggle mechanism 16 as defined by actuator link 7 and toggle links 9 and 10, as described previously.

As a result, the rubber blanket cylinder 1 is brought into contact with the impression cylinder 5 in accordance with the amount of eccentricity of the rubber blanket cylinder 1 relative to eccentric shaft 2.

On the other hand, if the link 8 is moved in the direction of arrow b, the arm or lever 21 is rotated counterclockwise about shaft 20 to drive the link 19 downwardly, parallel to the plane of the paper bearing the drawing, as a result of the toggle linkage action of actuator link 8 and toggle links 11 and 12, as previously described. As a result, the eccentric metal part 3 is rotated counterclockwise about its axis O″, while the rubber blanket cylinder eccentric shaft 2 is rotated clockwise about its axis O, so that the rubber blanket cylinder 1 is brought into contact with the plate cylinder 6.

By reciprocating the actuator links 7 and 8, respectively, in the direction of arrows a and a′ or in the direction of arrows b and b′, the rubber blanket cylinder 1 is moved into or out of engagement with the impression cylinder 5 and the plate cylinder 6. To modify the extent of pressure exerted by the rubber blanket cylinder 1 against the impression cylinder 5 and the plate cylinder 6 and the displacement of the periphery of the rubber blanket cylinder 1 with respect to the peripheries of cylinders 5 and 6, adjustments may be made by the simple expedient of rotatably adjusting the radial cams 38 and 39 by rotating their shafts 40 and 41, the result of which is to displace the toggle mechanisms 15 and 16. As a result, the contact pressure so of the rubber blanket cylinder 1 against the impression cylinder 5 and the rubber blanket cylinder 5 against the plate cylinder 6, namely, the printing pressure and the plate pressure, respectively, are varied.

When the ends of the adjusting screws 36 and 37 of adjusting arms 18 and 23 are at the very tops of the radial cams 38 and 39, respectively, as shown in the FIGURE, the printing pressure and plate pressure are of the highest magnitude. When the ends of the adjusting screws 36 and 37 are at the bottoms of the cams 38 and 39, respectively, the printing pressure and the plate pressure are at the lowest magnitude.

On the other hand, the printing pressure and the plate pressure are adjusted by adjusting the positions of the screws 36 and 37 with respect to the adjusting cams 38 and 39, permitting the adjustments to correct for errors resulting from the manufacture or assembly of the parts of the mechanism shown.

From the above description, it may be seen that the rubber blanket cylinder eccentric shaft 2 and the eccentric metal part 3 which supports the rubber blanket cylinder 1, provides support in such a manner that the cylinder 1 may be brought into and out of engagement with the impression cylinder 5 and the plate cylinder 6, individually, and that adjustment is effected by the couplings through the toggle mechanisms 15 and 16, respectively, to the first and second adjusting arms 18 and 23 which, in turn, are shifted through rotational adjustment of cams 38 and 39.

Accordingly, the plate pressure and printing pressure may be adjusted separately, and the pressures may be adjusted readily in a relatively short time. Furthermore, the operator can accurately adjust the plate pressure and printing pressure by merely rotating the adjusting cams 38 and 39 by rotating the operating shafts 40 and 41 to which the adjusting cams 38 and 39 are respectively fixed, while observing the printing operation of the printing machine and particularly the impression cylinder 5, the rubber blanket cylinder 1, and the plate cylinder 6 during the printing operation.

Since the adjusting screws are held in contact with the adjusting cams 38 and 39 by springs 32 and 33, respectively, once adjusted, there is no error in maintaining the adjustment and the adjusted pressure is retained by the components. Since a chain of positive engagement is retained through the mechanism, thereafter by varying the amount of eccentricity of adjusting cams 38 and 39, fine adjustments of plate pressure and printing pressure may be readily and accurately achieved and once made, fully maintained.

While the invention has been particularly shown and described with reference to a preferred embodiment thereof, it will be understood by those skilled in the art that various changes in form and details may be made therein without departing from the spirit and scope of the invention.

What is claimed is:

1. A plate pressure and printing pressure adjusting mechanism for an offset printing machine, said offset printing machine comprising:

a frame, an impression cylinder mounted for rotation about a fixed axis on said frame, a plate cylinder mounted for rotation about a fixed axis on said frame, parallel to the axis of rotation of said impression cylinder, with the peripheries of said plate cylinder and said impression cylinder being spaced from each other, a rubber blanket cylinder interposed between said pressure cylinder and said plate cylinder and parallel thereto for simultaneous peripheral contact with said plate cylinder and said impression cylinder, an eccentric metal part, means for mounting said eccentric metal part on said frame for rotation about an axis O″, an eccentric shaft, means for mounting said eccentric shaft on said eccentric metal part for rotation about a shaft axis O, eccentric to the axis O″ of said eccentric metal part, means for mounting said rubber blanket cylinder on said eccentric shaft with the axis O′ of said rubber blanket cylinder eccentric to the axis O of said eccentric shaft, said plate pressure and printing pressure adjusting mechanism comprising:

first and second toggle mechanisms positioned on the machine for reciprocation in predetermined directions to opposite sides of said eccentric shaft mounting said rubber blanket cylinder to effect shifting of said rubber blanket cylinder into and out of peripheral engagement with said plate cylinder and said impression cylinder, a first arm fixedly mounting on said eccentric shaft of said rubber blanket cylinder, a first adjusting arm pivotably supported on said frame, means for coupling said first adjusting arm through said first toggle mechanism to said first arm, a second arm pivotably supported on said frame, a link coupling said second arm to said eccentric metal part, a second adjusting arm pivotably supported on said frame and coupled through said second toggle mechanism to said second arm, adjusting cams adjustably mounted to said frame, adjusting screws threadably engaged with said first and said second adjusting arms, respectively, and terminating in threaded ends in contact with the peripheries of said radial adjusting cams, means connected to said first and second adjusting arms for biasing the threaded ends of said adjusting screws in contact with the peripheries of said radial cams such that by pivoting said radial adjusting cams on said frames, said first and second adjusting arms may be shifted independently;

whereby, said rubber blanket cylinder may be separately shifted through said first and second toggle mechanisms to separately adjust the plate pressure and printing pressure of said rubber blanket cylinder on said plate cylinder and said impression cylinder, respectively, during operation of the offset printing machine, while permitting ready and accurate fine adjustment of the respective plate pressure and printing pressure.

2. The plate pressure and printing pressure adjusting mechanism as claimed in claim 1, wherein said means for engaging the rubber blanket cylinder with the impression cylinder and the plate cylinder and for disengaging the same comprises two actuator links mounted for reciprocation on opposite sides of the rubber blanket cylinder eccentric shaft and in generally similar directions to effect engagement of disengagement of the rubber blanket cylinder, and wherein said actuator links form elements of said first and second toggle mechanisms, respectively.

3. The plate pressure and printing pressure adjusting mechanism as claimed in claim 2, wherein said first toggle mechanism comprises a first toggle link pivotably coupled at one end to an end of said first reciprocating link and pivotably connected at its opposite end to said first arm remote from the first arm connection to the eccentric shaft of the rubber blanket cylinder, said first adjusting arm comprises an L-shaped arm having portions intersecting at the pivot support of said first adjusting arm on said frame, one of said portions being proximate to the rubber blanket cylinder and being pivotably connected to the second toggle link of the first toggle mechanism, said biasing means comprising a first tension adjusting spring, one end of said first tension adjusting spring being connected to said frame and the other end of said first tension adjusting spring being connected to the end of said second portion of said first adjusting arm, remote from said first adjusting arm pivot connection to said frame, and wherein the second portion of said first adjusting arm, intermediate of the spring connection and the pivot connection carries said adjustable screw.

4. The plate pressure and printing pressure adjusting mechanism as claimed in claim 3, wherein said second actuator link is pin connected at one end to paired toggle links of said second toggle mechanism, said second arm is L-shaped and having right angle portions, and being pivotably connected at the intersection of the two portions of the arm to the frame, one toggle link of said second toggle mechanism is pivotably connected at the end remote from the cylinder setting device section actuator link to one end of portion of said second L-shaped arm, the other portion of said L-shaped second arm is pin connected to a link to one end of a link, which opposite end is pin connected to the eccentric metal part at a point remote from the axis of rotation of the eccentric metal part, said second toggle mechanism includes a second toggle link, said second toggle link being pin connected at one end to the end of said cylinder setting device second actuator link, said second adjusting arm comprises an L-shaped arm having two generally right angle portions and is pivotably supported on the frame at the intersection of the two right angle portions, one of said second adjusting arm portions, proximate to the rubber blanket cylinder, is connected to the end of said second toggle mechanism second toggle link, the other portion of said second adjusting arm has an end remote from said second adjusting arm pivot connection to the frame connected to a second adjusting spring, said second adjusting spring has its opposite end fixed to said frame, and an adjusting screw carried by said second adjusting arm and threadably projects therethrough, intermediate of the pivot connection of the second adjusting arm and the connection of the second adjusting spring to that arm portion.

5. The plate pressure and printing pressure adjusting mechanism as claimed in claim 4, wherein said adjusting cams comprise radial cams having radially varying peripheral cam surfaces fixedly mounted to respective operative shafts, and said shafts are rotatably mounted on said frame such that rotation of said cams causes the ends of the adjusting screws to follow the radially varying peripheral cam surfaces of the radial cams to effect pivoting of the first and second adjusting arms about their pivot axes and against the bias of the first and second adjusting springs, respectively.

* * * * *